United States Patent [19]

Hall

[11] 4,361,156

[45] Nov. 30, 1982

[54] METHOD AND APPLICATOR FOR APPLYING GLUE TO A TRAVELLING STREAM OF TIPPING PAPER

[75] Inventor: Floyd V. Hall, Durham, N.C.

[73] Assignee: Liggett Group Inc., Montvale, N.J.

[21] Appl. No.: 163,065

[22] Filed: Jun. 26, 1980

[51] Int. Cl.[3] ..... A24C 1/34

[52] U.S. Cl. ..... 131/90; 131/35; 131/37; 131/68; 131/69; 131/92

[58] Field of Search ..... 118/212; 131/349, 94, 131/60, 67, 69, 34, 35, 37, 58, 90, 70 R, 94; 101/170; 156/291; 428/214

[56] References Cited

U.S. PATENT DOCUMENTS

| | | | |
|---|---|---|---|
| 2,149,896 | 3/1939 | McArdle et al. | 118/212 |
| 2,324,486 | 7/1943 | Clausen | 118/212 |
| 4,174,720 | 11/1979 | Hall | 131/342 |
| 4,249,547 | 2/1981 | Hinzmann | 131/69 |

*Primary Examiner*—V. Millin

*Attorney, Agent, or Firm*—Kenyon & Kenyon

[57] ABSTRACT

The applicator roll is provided with two recesses to apply uniform layers of glue to a travelling stream of tipping paper. In addition, the applicator roll has a series of spaced apart grooves in each recess so as to apply additional stripes of glue onto the tipping paper near the edges. The additional stripes of glue provide for a more secure bonding of the tipping paper to the tobacco column of the filter cigarette construction.

13 Claims, 9 Drawing Figures

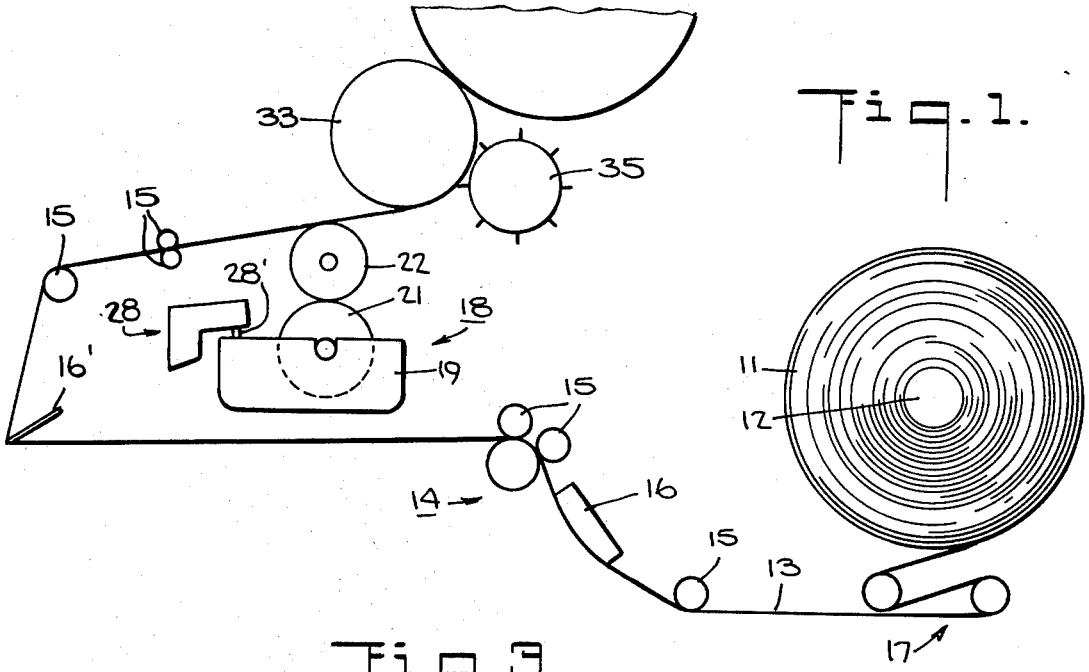
Fig. 1.
Fig. 3.
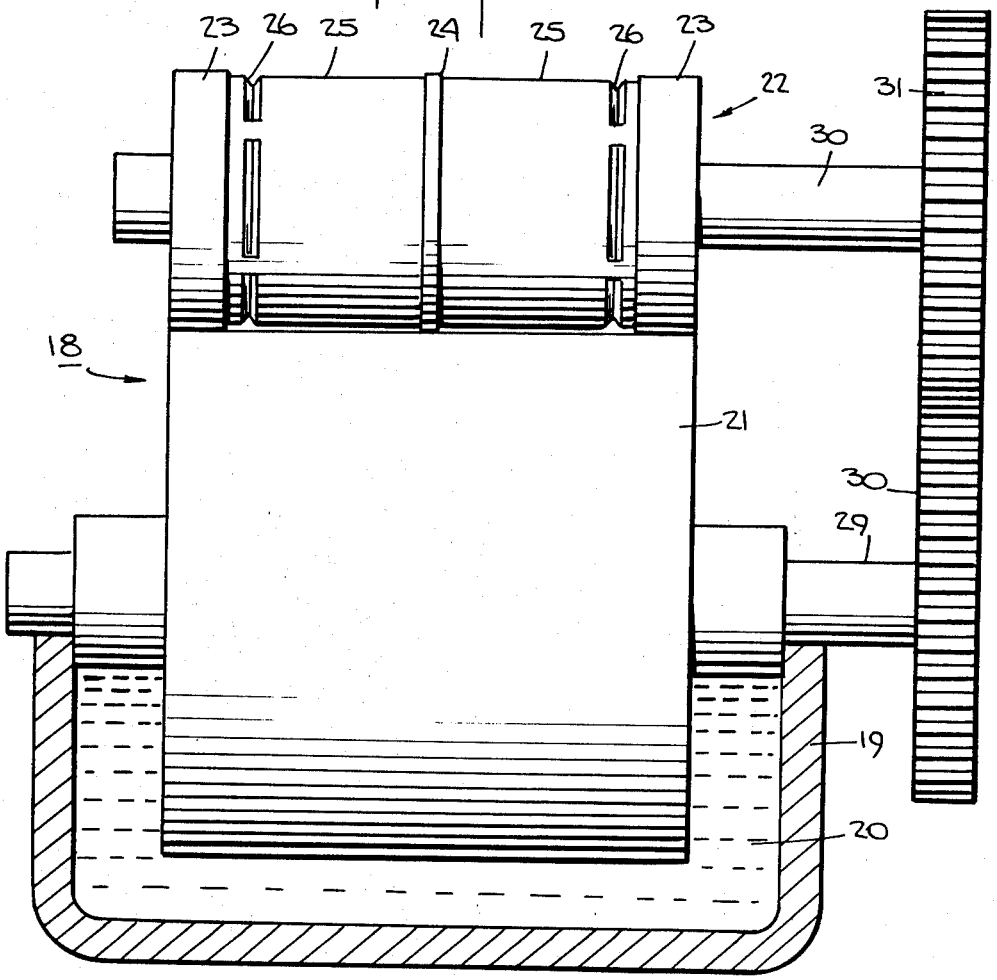

22
23
25
26
27
20
13
19
21
24
15
18
16
29
4

METHOD AND APPLICATOR FOR APPLYING GLUE TO A TRAVELLING STREAM OF TIPPING PAPER

This invention relates to an applicator for applying glue to a travelling stream of tipping paper. More particularly, this invention relates to an applicator for and method of applying glue to tipping paper for securing a filter to a tobacco column for a cigarette as well as to an improved filter cigarette construction.

As is known, filters of the fibrous-entrainment type or cavity type are generally abutted against a tobacco column and secured in place by a wrapping of tipping paper in order to form a filter cigarette. To this end, the tipping paper is usually provided with a glue or adhesive over the entire surface or only at certain sections depending on the type of filter, for example as described in U.S. Pat. No. 4,174,720, in order to secure the filter and tobacco column together.

Generally, the tipping paper overlaps the tobacco column in order to provide a bonding area for securing the tipping paper to the tobacco column. If there is an insufficient area of bond between the tobacco column and tipping paper, the tobacco column may break away from the filter thus destroying the intended use of the filter cigarette. Thus, in order to insure fixation to the tobacco column, it has sometimes been necessary to use a wide strip of tipping paper to furnish a suitable overlap of the tipping paper on the tobacco column. This not only requires additional amounts of tipping paper but also wider widths in the equipment used to apply the glue to the paper.

Accordingly, it is an object of the invention to provide a secure fixation of a tobacco column to a filter.

It is another object of the invention to reduce the amount of tipping paper required for bonding a tobacco column and filter together.

It is another object of the invention to provide an applicator of simple construction for applying glue in excess at predetermined points of a stream of tipping paper for use in forming a filter cigarette.

Briefly, the invention provides an applicator for and a method of applying glue to a travelling stream of tipping paper as well as to an improved filter cigarette construction.

The applicator includes a glue pot which contains a reservoir of glue, a transfer roll which is rotatably mounted over the glue pot and has a circumferential surface projecting into the pot to receive glue thereon and an applicator roll which is rotatably mounted on and over the transfer roll to receive a layer of glue therefrom. The applicator roll also has at least one row of circumferentially spaced apart elongated grooves therein which are sized and shaped to receive a stripe of glue therein.

The applicator cooperates with a means for conveying a stream of tipping paper through a predetermined path so as to apply glue to an underside of the travelling stream of tipping paper. In this regard, the glue is applied in a substantially uniform layer across the width of the tipping paper with a superimposed additional stripe of glue coincident with the groove in the applicator roll.

When in use in a filter cigarette making machine, the applicator also cooperates with a means for positioning a series of filters in alignment with the conveyed stream of tipping paper with each filter disposed transversely of the conveyed stream; a means for positioning a series of tobacco columns in alignment with the conveyed stream of tipping paper with each tobacco column disposed coaxially of a respective filter and transversely over a respective glue stripe; and a means for severing the conveyed tipping paper stream transversely between each respective pair of glue stripes to form a tipping paper strip. This latter means cooperates with a further means for wrapping each strip circumferentially about an aligned tobacco column and filter in order to secure the tobacco column and filter together.

The method includes the step of providing a strip of tipping paper with a layer of glue on one surface and an additional stripe of glue near one edge of the surface. The method also includes the steps of disposing a filter on a surface of the tipping paper transversely of the stripe of glue, disposing a tobacco column coaxially of the filter and transversely over the glue stripe and wrapping the strip circumferentially about the filter and tobacco column to secure the filter and tobacco column together.

These and other objects and advantages of the invention will become more apparent from the following detailed description taken in conjunction with the accompanying drawings wherein:

FIG. 1 illustrates a schematic view of an apparatus for applying glue to a stream of tipping paper and for forming a filter cigarette in accordance with the invention;

FIG. 3 illustrates a front view of the applicator of FIG. 2;

Figures 2, 4:
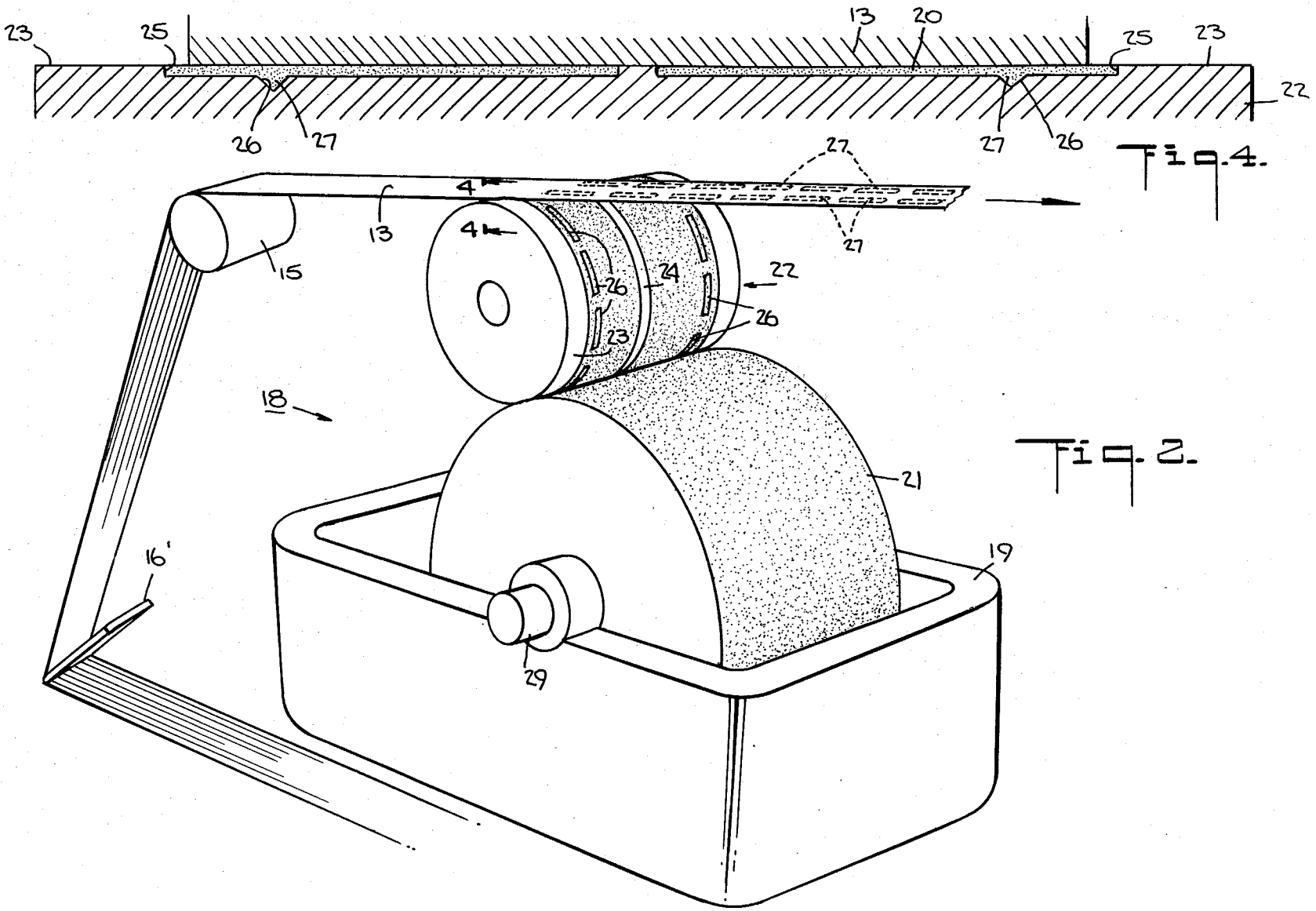
FIG. 2 illustrates a perspective view of an applicator in accordance with the invention.
FIG. 4 illustrates a view taken on line 4—4 of FIG. 2.

Referring to FIG. 1, the machine 10 for making a filter cigarette contains various components of conventional structure which will not be further described below. As indicated, the machine 10 includes a tipping paper roll 11 which is suitably mounted on a rotatable shaft 12 to feed a stream of tipping paper 13 to a means 14 for conveying the stream of tipping paper 13 through a predetermined path. As indicated, the conveying means 14 includes guide and drive rolls 15 for conveying the tipping paper 13 through the machine 10 as well as a vacuum break 15 and straightener 16'. A suitable tensioning assembly 17 is also provided to maintain a uniform tension in the tipping paper stream.

As shown in FIG. 1, an applicator 18 is disposed below the travelling stream of tipping paper 13 at one point in the path of the paper 13 for applying glue to the paper 13.

Referring to FIG. 2, the applicator 18 includes a glue pot 19 which contains a reservoir of glue 20, a transfer roll 21 which is rotatably mounted over the glue pot 19 and which has a smooth circumferential surface projecting into the pot to receive glue thereon and an applicator roll 22 which is rotatably mounted on and over the transfer roll 21 to receive a layer of glue therefrom. As shown, the applicator roll 22 has a raised ring 23 at each end and a raised circumferential rib 24 at a central point so as to form a pair of recesses 25 for receiving a uniform layer of glue therein (see FIG. 4). Further, the applicator roll 22 has a row of circumferentially spaced apart elongated grooves 26 in each recess 25. Each of these grooves 26 is sized and shaped to receive a stripe of glue 27 therein (see FIG. 4). For example, each groove has a depth of 0.025 inches and a width at the widest part of 0.025 inches. As shown in FIGS. 2 and 3, the rims 23 and central rib 24 contact the surface of the transfer roll 21 and are of the same outer diameter.

As shown in FIG. 3, each row of grooves 26 is spaced inwardly of a rim 23, for example at a distance of 3.5 millimeters from the center-line of the groove 26 to the inside rim wall.

Referring to FIG. 1, the applicator 18 is also provided with a suitable feed means 27 for feeding a supply of glue to the glue pot 19 as well as a sensor 28 for sensing the level of glue 20 within the pot 19 so as to institute a feed of fresh glue to the pot 19 to maintain a substantially constant level therein. As also shown in FIG. 3, the transfer roll 21 is rotatably mounted via a shaft 29 on the pot 19. This shaft 29 is driven from the drive of the machine 10 in known synchronized manner with the remaining machine components. The applicator roll 22 is likewise carried by a shaft 30 which is driven off the transfer roll shaft 29 via a pair of meshing gears 30, 31.

Figures 5, 6, 7, 8, 9:
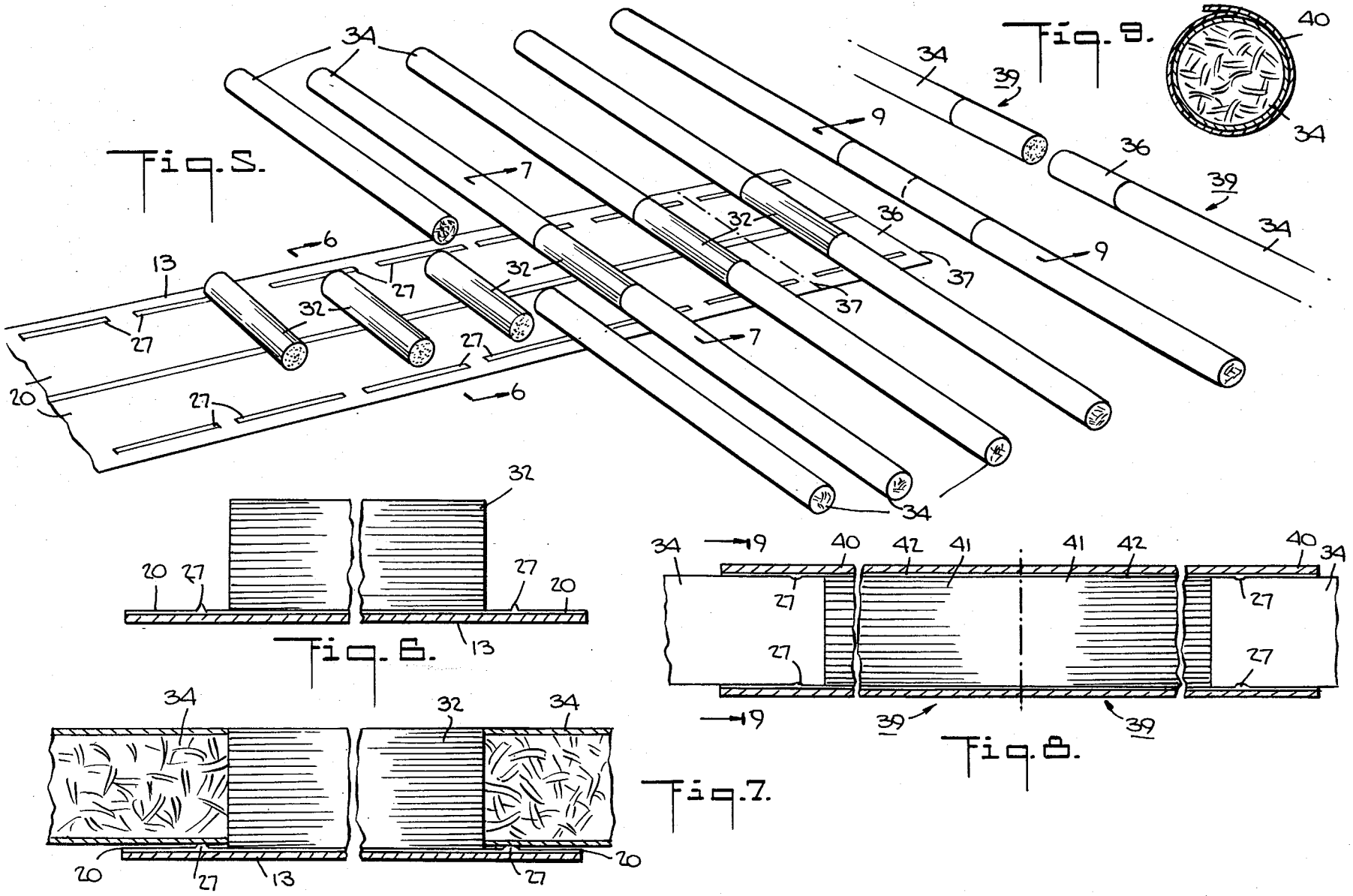
FIG. 5 illustrates a schematic view of a sequence of steps of forming a filter in accordance with the invention.
FIG. 6 illustrates a view taken on line 6—6 of FIG. 5.
FIG. 7 illustrates a view taken on line 7—7 of FIG. 5.
FIG. 8 illustrates a view taken on line 8—8 of FIG. 5.
FIG. 9 illustrates a view taken on line 9—9 of FIG. 8.

Referring to FIG. 1, the machine 10 also has a means (not shown) for positioning a series of filter plugs 32 (see FIG. 5) in alignment with the conveyed stream of tipping paper 13, for example on an alignment drum 33, with each filter plug 32 disposed transversely of the conveyed stream 13 as shown in FIG. 1. To this end, each filter plug 32 (which is sized to provide two filters) is disposed centrally between the two rows of glue stripes 27. In addition, a means (not shown) is provided for positioning a series of tobacco columns 32 in alignment with the conveyed stream of tipping paper 13 on the alignment drum 33 with each tobacco column 34 disposed coaxially of a respective filter plug 32 and transversely over a respective glue stripe 27 as shown in FIG. 5.

In addition, the machine 10 is provided with a means such as a cutter 35 adjacent the aligning drum 33, for severing the conveyed tipping paper stream 13 transversely between each respective pair of glue stripes 27 in order to form a tipping paper strip 36. As shown in FIG. 5, the cutter 35 forms a sequence of cuts 37 in the tipping paper stream 13 to form the individual strips 36 of tipping paper.

Further, a means (not shown) is provided for wrapping each tipping paper strip 36 circumferentially about the aligned tobacco columns 34 and filter plug 32 in order to secure the tobacco columns 34 and filter plug 32 together. As shown in FIG. 9, when the tipping paper strip 36 is wrapped about the filter plug 32 and tobacco columns 34, the tipping paper strip 36 is overlapped on itself to form a flap 38. This flap 38 contains a layer of glue on the inside surface; however, the stripes of glue 27 do not extend into this flap 38. Instead, the stripes of glue 27 terminate short of the flap 38.

As shown in FIG. 3, the grooves 26 are spaced apart in each row at a distance of, for example about 3 millimeters. This provides for the overlap when wrapping the subsequent tipping paper strip 36 about a filter plug 32 and the tobacco columns 34 for joining purposes.

Referring to FIG. 4, when glue 20 is transferred from the smooth transfer roll 21 to the applicator roll 22 and thence to the stream of tipping paper 13, the glue completely fills the recesses 25 defined by the rims 23 and raised rib 24 as well as the grooves 27. This glue is transferred onto the underside of the tipping paper 13 as the paper moves from the applicator roll 22.

In operation, the stream of tipping paper 13 is dispensed from the tipping paper roll 11 and leads over and through the various guide rolls 15, a vacuum break 16, and straightener 16 as well as the applicator roll 22 of the applicator 18. At this time, the underside of the tipping paper stream 13 picks up two layers of glue of substantially uniform thickness from the two recesses 25 of the applicator roll 22. In addition, an additional stripe of glue 27 is transferred within each layer of glue from the groove 26 in each recess 25. The tipping paper 13 then proceeds to the aligning drum 33 whereat a series of filter plugs 32 and tobacco columns 34 are aligned with the glue containing surface of the tipping paper 13. As shown in FIG. 5, the filter plugs 32 are located within the rows of glue stripes 27 while the tobacco columns 34 are disposed transversely over each respective stripe 27. Subsequently, the tipping paper 13 is severed between each respective pair of glue stripes 27 to form the individual strips 36 of tipping paper. Thereafter, these strips 36 are individually wrapped about a filter plug 32 and a pair of coaxially aligned tobacco columns 34 to secure the filter plug 32 to the two tobacco columns 34 as a unit. Subsequently, each of these units is then severed intermediately of the filter plug 32 by suitable means in order to form two filter cigarette constructions 39.

As shown in FIG. 8, each resultant filter cigarette construction 39 has a strip of tipping paper 40 circumferentially disposed about a tobacco column 34 and a filter 41 with the strip 40 having a layer of glue 42 thereon bonding the strip 40 to the tobacco column 34 and filter 41 as well as a circumferential stripe of glue 27 bonding the strip 40 to the tobacco column 34. As indicated above, the stripe of glue 27 is located about 2.5 millimeters inwardly of the edge of the tipping paper 40 over the tobacco column 34.

Referring to FIG. 4, the width of the applicator roll 22 from the inside surfaces of the rims 23 is equal to the width of the tipping paper 13 plus two millimeters. Further, the spacing between the two rows of grooves 27 is equal to the width of the tipping paper 13 minus five millimeters. Also, the raised rib 24 and rims 23 extend upwardly from the surface of the roll 22 a distance of 0.0014 inches. It is to be noted that the circumferential rib 24 on the applicator roll 22 prevents glue from being disposed centrally along the travelling stream of tipping paper 13. Thus, when the filter plugs 32 (FIG. 5) are severed intermediately thereof, there is no glue between the tipping paper strip 40 and the filter 41 at the free end of the filter cigarette construction (FIG. 8).

The invention thus provides an applicator and method of applying suitable auxiliary means to a travelling stream of tipping paper so as to insure a firm fixation of a filter to a tobacco column in a filter cigarette construction.

The invention further permits the use of narrower widths of tipping paper and corresponding narrower widths of applicator rolls for applying glue onto the tipping paper.

What is claimed is:

1. An applicator for applying glue to a travelling stream of tipping papers, said applicator including:

a glue pot containing a reservoir of glue;

a transfer roll rotatably mounted on said glue pot and having a circumferential surface projecting into said pot to receive glue thereon; and an applicator roll rotatably mounted on and over said transfer roll to receive a layer of glue thereon, said applicator roll having a pair of rims disposed in rolling contact with said transfer roll, each said rim being disposed at a respective edge of said applicator roll, at least one row of circumferentially spaced apart elongated grooves therein spaced laterally from said rims, each said groove being sized and shaped to receive a stripe of glue therein.

2. An applicator as set forth in claim 1 wherein said applicator roll has a pair of said rows of grooves therein and a raised circumferential rib located centrally of said rows with an outer diameter equal to an outer diameter of said rims.

3. In combination:

means for conveying a stream of tipping paper through a predetermined path; and an applicator in said path for applying glue to an underside of the travelling stream of tipping paper, said applicator including:

a glue pot containing a reservoir of glue;

a transfer roll rotatably mounted over said glue pot and having a circumferential surface projecting into said pot to receive glue thereon; and an applicator roll rotatably mounted over said transfer roll to receive a layer of glue therefrom and under the stream of tipping paper to deliver the glue thereto, said applicator roll having a pair of rows of circumferentially spaced apart elongated grooves therein to receive stripes of glue and a raised circumferential rib centrally of said rows and in contact with said transfer roll.

4. The combination as set forth in claim 3 wherein said applicator roll has a pair of rims disposed in rolling contact with said transfer roll, each said rim being disposed at a respective edge of said applicator roll and having an outer diameter equal to an outer diameter of said rib.

5. In combination, means for conveying a stream of tipping paper through a predetermined path;

an applicator for placing at least one row of circumferentially spaced apart stripes of glue on one surface of the conveyed stream, said applicator including a glue pot containing a reservoir of glue; a transfer roll rotatably mounted over said glue pot and having a circumferential surface projecting into said pot to receive glue thereon; and an applicator roll rotatably mounted over said transfer roll to receive a layer of glue therefrom, said applicator roll having a pair of rows of circumferentially spaced apart elongated grooves therein to receive stripes of glue and a raised circumferential rib located centrally of said rows and in contact with said transfer roll;

means for positioning a series of filters in alignment with the conveyed stream with each filter disposed transversely of the conveyed stream;

means for positioning a series of tobacco columns in alignment with the conveyed stream with each tobacco column disposed coaxially of a respective filter and transversely over a respective glue stripe;

means for severing the conveyed tipping paper stream transversely between each respective pair of glue stripes to form a tipping paper strip; and means for wrapping each strip circumferentially about an aligned tobacco column and filter to secure the tobacco column and filter together.

6. The combination as set forth in claim 5 wherein each groove has a depth of 0.025 inches and a width at the widest part of 0.025 inches.

7. The combination as set forth in claim 5 wherein said transfer roll has a smooth circumferential surface.

8. The combination as set forth in claim 5 wherein each groove has a depth of 0.025 inches and said rib has a height of 0.0014 inches.

9. The combination as set forth in claim 5 wherein said grooves are spaced apart a distance of about 3 millimeters.

10. A method of securing a filter to a tobacco column, said method comprising the steps of:

providing a strip of tipping paper with a uniform layer of glue on a surface thereof and a superposed stripe of glue on said layer spaced laterally from near one edge of said surface;

disposing a filter on said surface of the tipping paper transversely of said stripe of glue;

disposing a tobacco column coaxially of the filter and transversely over the glue stripe; and wrapping said stripe circumferentially about the filter and tobacco column to secure the filter and tobacco column together.

11. A method as set forth in claim 10 wherein said strip is provided with a parallel pair of said stripes of glue, each said stripe being disposed on opposite sides of said strip; a pair of tobacco columns are disposed coaxially of said filter on opposite sides thereof; said strip is wrapped circumferentially about said filter and tobacco columns to secure said filter and tobacco columns together; and said filter is severed intermediately thereof to form two filter cigarettes.

12. An applicator for applying glue to a travelling stream of tipping paper, said applicator including:

a glue pot containing a reservoir of glue;

a transfer roll rotatably mounted on said glue pot and having a circumferential surface projecting into said pot to receive glue thereon; and an applicator roll rotatably mounted on and over said transfer roll to receive a layer of glue thereon, said applicator roll having a pair of rows of circumferentially spaced apart elongated grooves therein, each said groove being sized and shaped to receive a stripe of glue therein and a raised circumferential rib located centrally of said rows.

13. An applicator as set forth in claim 12 wherein said applicator roll has a pair of rims disposed in rolling contact with said transfer roll, each said rim being disposed at a respective edge of said applicator roll and having an outer diameter equal to an outer diameter of said rib.

* * * * *